US012013117B2

(12) United States Patent
Cusano

(10) Patent No.: US 12,013,117 B2
(45) Date of Patent: Jun. 18, 2024

(54) INJECTORS FOR SUPERCRITICAL $CO_2$ APPLICATIONS

(71) Applicant: G2 Power, Inc., Riviera Beach, FL (US)

(72) Inventor: David M. Cusano, Jupiter, FL (US)

(73) Assignee: G2 Power, Inc., Riviera Beach, FL (US)

( * ) Notice: Subject to any disclaimer, the term of this patent is extended or adjusted under 35 U.S.C. 154(b) by 0 days.

(21) Appl. No.: 17/205,553

(22) Filed: Mar. 18, 2021

(65) Prior Publication Data

US 2021/0293408 A1 Sep. 23, 2021

Related U.S. Application Data

(60) Provisional application No. 62/991,362, filed on Mar. 18, 2020.

(51) Int. Cl.

| | |
|---|---|
| ***F23D 14/76*** | (2006.01) |
| ***F23D 14/78*** | (2006.01) |
| ***F23L 7/00*** | (2006.01) |

(52) U.S. Cl.
CPC ..... *F23D 14/76* (2013.01); *F23D 14/78* (2013.01); *F23L 7/00* (2013.01)

(58) Field of Classification Search
CPC ..... F23L 7/00; F23D 14/78; F23D 14/76
USPC ..... 431/4, 8–9, 182–184
See application file for complete search history.

(56) References Cited

U.S. PATENT DOCUMENTS

| | | | | |
|---|---|---|---|---|
| 4,718,393 | A | 1/1988 | Bakish | |
| 5,571,424 | A | 11/1996 | Ahluwalia | |
| 6,474,569 | B1 * | 11/2002 | Brundish | F23C 7/008 60/39.23 |
| 2007/0214712 | A1 | 9/2007 | Garwood | |
| 2009/0272822 | A1 | 11/2009 | Davis et al. | |
| 2010/0270223 | A1 | 10/2010 | Arnaud | |
| 2013/0244187 | A1 | 9/2013 | Kraus et al. | |
| 2018/0259183 | A1 | 9/2018 | Fetvedt et al. | |
| 2019/0078777 | A1 | 3/2019 | Keller et al. | |

FOREIGN PATENT DOCUMENTS

| | | | |
|---|---|---|---|
| EP | 2113717 | A2 | 11/2009 |

OTHER PUBLICATIONS

Wang, Xingjian., Li, Yixing., Wang Yanxing., Yang, Vigor. Near-field flame dynamics of liquid oxygen/kerosene bi-swirl injectors at supercritical conditions. Combustion and Flame. 190. 2018 (Year: 2018).*

"Natural gas vehicle", Wikipedia, retrieved from https://en.wikipedia.org/wiki/Natural_gas_vehicle#:~:text=Methane%20is%20the%20cleanest%20burning, either%20gasoline%20or%20natural%20gas), retrieved Jun. 15, 2021, pp. 1-26.

* cited by examiner

*Primary Examiner* — Vivek K Shirsat

(74) *Attorney, Agent, or Firm* — The Webb Law Firm

(57) ABSTRACT

An apparatus and method for injectors for use in combustion systems employing multiple non-solid or gas streams such as supercritical $CO_2$ systems. The apparatus and method allow for reactants to be injected into a combustion chamber in such a way that combustion is locally inhibited. Injectors employing an inner and outer tube are designed to minimize mixing between the non-solid gas streams and allow for swirling and stratification of the non-solid or gas streams.

18 Claims, 2 Drawing Sheets

INJECTORS FOR SUPERCRITICAL $CO_2$ APPLICATIONS

CROSS REFERENCE TO RELATED APPLICATIONS

The present application claims priority to U.S. Provisional Patent Application No. 62/991,362, filed on Mar. 18, 2020, the disclosure of which is hereby incorporated by reference in its entirety.

BACKGROUND OF THE INVENTION

Field of the Invention

The present invention relates to an apparatus and method for injectors for use in combustion systems. This technology is considered for systems requiring the introduction of combinations of fuel-fuel, fuel-inert, oxidizer-inert, or oxidizer-oxidizer into the combustion chamber. Inert, in this case, includes the classic definition plus complete combustion product species such as water/steam and carbon dioxide. Supercritical $CO_2$ combustion systems are the primary application for this technology but it can be employed in any system employing multiple gas streams.

Background of the Invention

Supercritical $CO_2$ systems are unique from any other traditional combustion system in that they have large amounts of combustion product gas ($CO_2$) which is typically recirculated from the exhaust back into the inlet of the combustor. Combustion product gases are essentially inert in nature which, when introduced into the combustion chamber in proximity of the fuel or oxidizer, can inhibit reactions. This is of particular interest when the combustion process has high flame speeds, very short ignition delay times, or are in an autoignition condition. These considerations apply to supercritical $CO_2$ systems, but also to many other combustion systems.

SUMMARY OF THE INVENTION

The following description is merely exemplary in nature and is in no way intended to limit the invention, its application, or uses. While the description is designed to permit one of ordinary skill in the art to make and use the invention, and specific examples are provided to that end, they should in no way be considered limiting. It will be apparent to one of ordinary skill in the art that various modifications to the following will fall within the scope of the appended claims. The present invention should not be considered limited to the presently disclosed embodiments, whether provided in the examples or elsewhere herein.

The present invention relates to an apparatus and method to inject reactants into a combustion chamber in such a way that combustion is locally inhibited. Delaying the reaction moves the high temperature combustion species and reactions away from the injectors and other combustion chamber hardware improving durability and survivability of such hardware.

An injector in one preferred embodiment of the invention, comprises an outer cylindrical tube comprising an inner diameter and a first end and a second end, wherein said first end is connected to a source of a first non-solid and said second end comprises an annular or circular exit; and an inner cylindrical tube positioned within said outer cylindrical tube, wherein said inner cylindrical tube comprises an inner diameter and a first end and a second end wherein said first end is connected to a source of a second non-solid and said second end comprises an annular or circular exit; and wherein said second end of said inner cylindrical tube is positioned relative to said outer cylindrical tube such that said second end of said inner cylindrical tube is located an axial distance away from said second end of said outer cylindrical tube; and wherein said inner diameter of said outer cylindrical tube is configured to swirl said first non-solid and said inner diameter of said second cylindrical tube is configured to swirl said second non-solid such that said first non-solid and said second non-solid remain swirled and stratified into separate layers of flow for each gas as they flow through the exits of the inner and outer tubes. Swirl is defined as any component of velocity not aligned with the tube axis and includes zero. In preferred embodiments, the first non-solid may comprise supercritical $CO_2$ and the second non-solid may comprise $CH_4$.

A method of injecting an inert into a combustion chamber comprising at least one injector comprising an outer tube and an inner tube positioned within said outer tube, in one preferred embodiment, comprises the steps of: flowing an inert into said outer tube of said at least one injector; swirling the inert as it flows through said outer tube; flowing a non-solid into said inner tube of said at least one injector; swirling the non-solid as it flows through said inner tube; injecting the swirled inert and swirled non-solid from said outer and inner tubes into said combustion chamber such that the swirled inert delays the mixing of swirled non-solid in said combustion chamber thereby preventing reactions for some distance beyond the point of injection of said at least one injector. In preferred embodiments, the non-solid may comprise fuel (e.g. CH4), oxidizerand the inert may comprise supercritical $CO_2$ or steam.

A method of injecting a non-solid into a combustion chamber comprising at least one injector comprising an outer tube and an inner tube positioned within said outer tube, in one preferred embodiment of the invention, comprises the steps of: flowing the non-solid into said outer tube of said at least one injector to form an outer stream of the non-solid; flowing the non-solid into said inner tube of said at least one injector to form an inner stream of the non-solid; injecting the non-solid from said outer and inner tubes into said combustion chamber such that the inner and outer streams enter into said combustion chamber with enhanced turbulence caused by the inner and outer streams experiencing high shear forces due to either a difference in axial velocity, a difference in swirl velocity or direction or a combination of these effects, downstream of said at least one injector.

The non-solid may comprise a fuel or an oxidizer in preferred embodiments. Optionally, preferred methods may further comprise swirling the non-solid as it flows through said outer tube, or swirling the non-solid as it flows through the inner tube, or swirling the non-solid as it flows through both the inner and the outer tube. In other preferred embodiments two different fuels or two different oxidizers may be flowed, and optionally swirled as they flow, through the inner and outer tubes wherein one fuel or oxidizer is flowed through the outer tube and a different fuel or oxidizer is flowed through the inner tube.

The present design provides a small delay to the combustion process while being highly effective at mixing the reactants. This can be accomplished by using the weights of the non-solids or gases along with swirling the non-solids or gases to keep reactants stratified. Large numbers of discrete injection elements or injectors can also be utilized. Both the fuel and oxidizer can be stratified: fuel #1-fuel #2, fuel-inert, oxidizer-inert, or oxidizer #1-oxidizer #2. The present injectors can be used in any non-premixed combustor designs.

Swirling can be initiated by tangential entry, rifling, or helical ribbon inserts. Unlike typical injectors, the present injectors comprise an outer tube forming an exit of the injector, and an inner tube located within the outer tube that includes its own exit that stops short of the exit of the outer tube of the injector. In one preferred embodiment, the inner and outer tubes can be cylindrical. The exits of the inner cylindrical tubes are designed to minimize the mixing between the two streams. As the two fluids continue in the outer tube, the mixing of the streams is minimized by proper selection of the temperature, density, velocity, and swirl of the streams. In one preferred embodiment, the exits of the inner and outer tubes can be the annular ends of the cylindrical tubes. One of ordinary skill in the art would appreciate that other configurations for the tubes and exits could be incorporated in the design.

In one preferred embodiment, stratification can be accomplished by using temperature differential to effect the densities so as to aid in stratification.

In one preferred embodiment of the invention, supercritical $CO_2$ and $CH_4$ can be swirled the same amount in an injector comprising an outer tube forming an exit of the injector, and an inner tube that stops short of the exit of the injector. The $CH_4$ can be introduced into the combustion chamber through the inner tube of the injectors and the supercritical $CO_2$ can be introduced through the outer tube of the injector. The supercritical $CO_2$ and $CH_4$ can be swirled in the injector by tangential entry of the supercritical $CO_2$ and $CH_4$ into the injector tubes, rifling on the inner surface of the inner and outer injector tubes, helical ribbon inserts within the inner and outer injector tubes, or a combination of such elements. The supercritical $CO_2$ and $CH_4$ can be supplied to the injector from separate sources of supply operably connected to the inner and outer tubes respectively.

According to the present design, a plurality of injectors can be utilized within a combustion chamber, or such that the exits of the injectors flows gases into the combustion chamber.

DETAILED DESCRIPTION OF THE PREFERRED EMBODIMENTS

Figure 1:
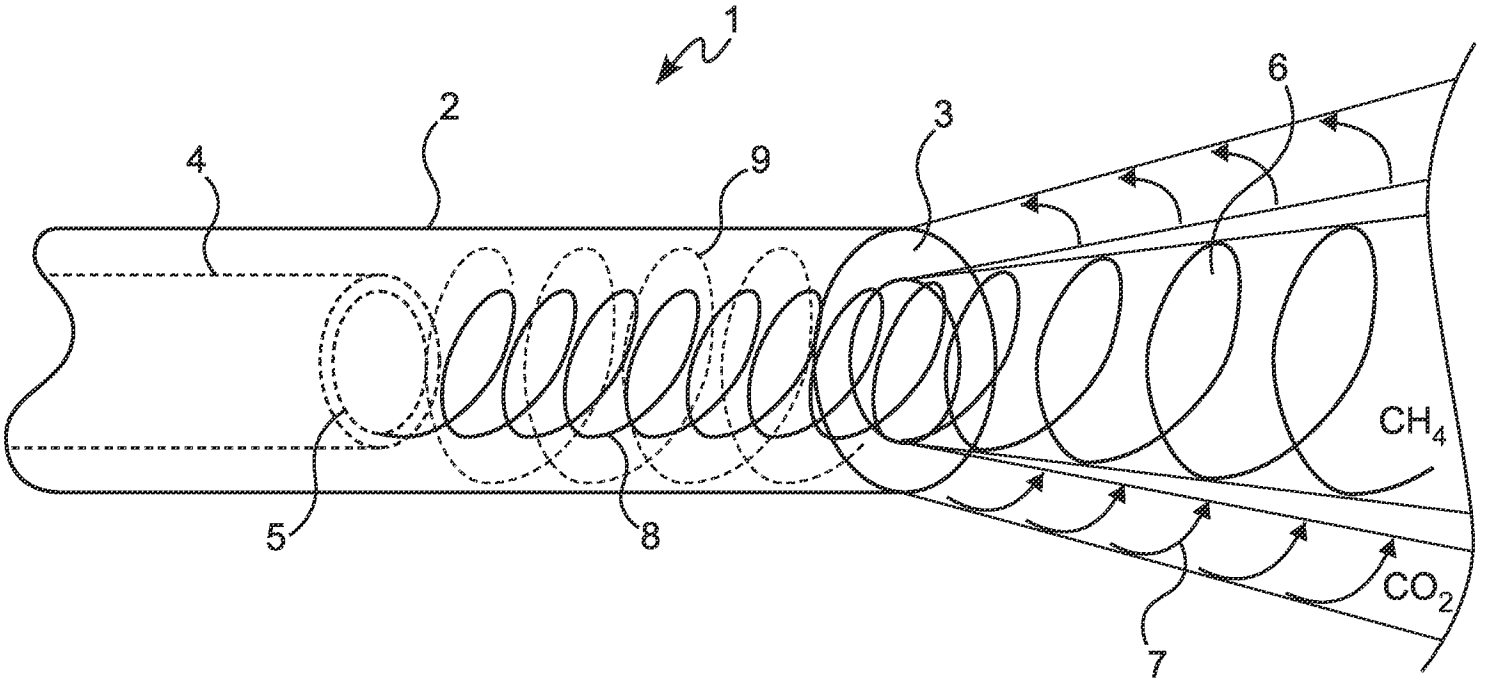
FIG. 1 is a perspective and partial section view of a preferred embodiment of an injector designed in accord with the present invention showing the flow of $CO_2$ and $CH_4$ through and after exiting the injector.

With reference to FIG. 1, in one preferred embodiment, an injector 1 comprises a cylindrical outer tube 2 comprising an annular exit 3 and a cylindrical inner tube 4 of smaller diameter and length positioned within the outer tube 2. The inner tube 4 comprises an annular exit 5. Although not illustrated, the inner tube is operably connected to a source for a first gas at the end opposite the annular exit 5. The outer tube is operably connected to a separate source for a second gas at the end opposite the annular exit 5. The first and second gases flow from their separate sources into and through the inner and outer tubes and exit the inner and outer tubes into the combustion chamber.

In preferred embodiments, said first gas may be an oxidizer or a fuel, and said second gas may be inert (non-participating). In the preferred embodiment depicted in FIG. 1, the first gas 9 may be supercritical $CO_2$ and the second gas 8 may be $CH_4$.

In one preferred embodiment, as depicted in FIG. 1, the flow of supercritical $CO_2$ 9 is swirled as it flows through the outer tube 2 of the injector and remains swirled as it exits the injector through the nozzle exit 3 into the combustion chamber (not shown), such that it remains stratified into its own layer 7 in the flow of gases from the exit 3 of the injector 1 with respect to the flow of swirled $CH_4$ 8, which remains stratified into its own layer 6 in the flow of gases as it exits the injector such that mixing of the two gases (not shown) only occurs downstream of the exit 3 of the outer tube 2 of the injector 1. The supercritical $CO_2$ 9 and $CH_4$ 8 can be swirled in the injector by tangential entry of the supercritical $CO_2$ 9 and $CH_4$ 8 into the injector tubes, rifling on the inner surface of the inner 2 and outer 4 injector tubes, helical ribbon inserts within the inner 4 and outer 2 injector tubes, or a combination of such elements.

Figure 2:
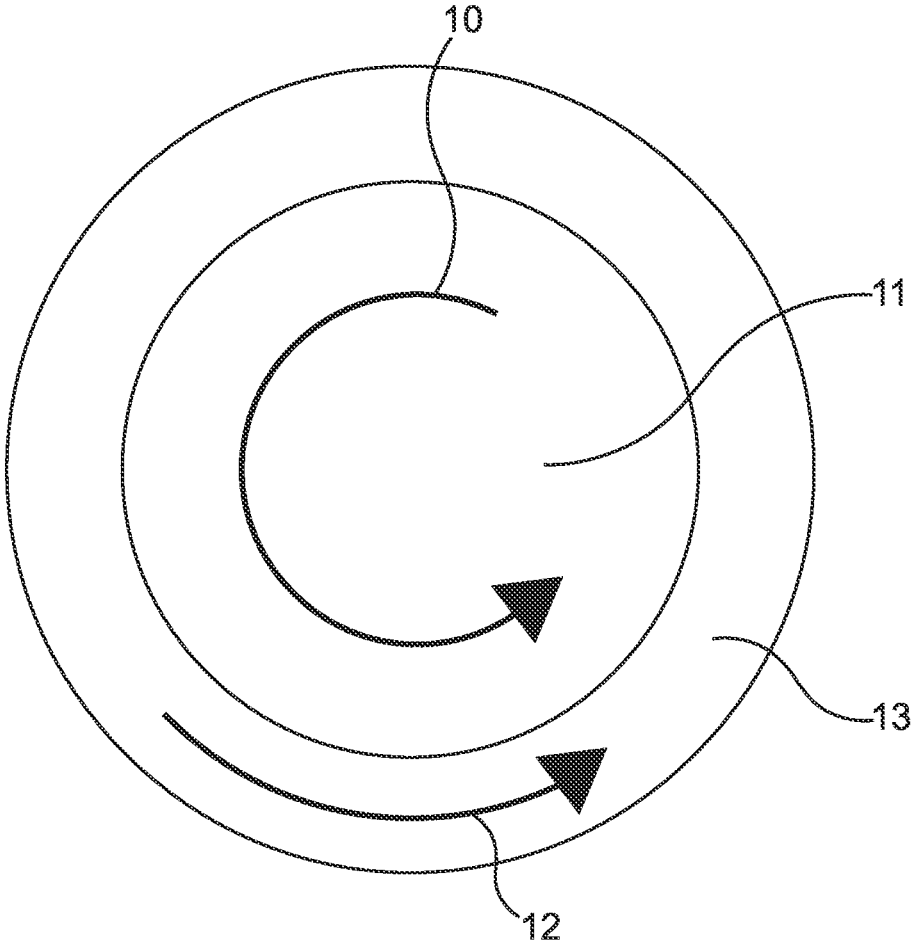
FIG. 2 is a section view of the resulting flow of $CO_2$ and $CH_4$ at the nozzle end of the outer tube of an injector designed in accord with the present invention.

With reference to FIG. 2, in one preferred embodiment, swirled supercritical $CO_2$ 12 exits the injector such that it is stratified into its own layer 13 in the flow of gases from the injector, with respect to the swirled $CH_4$ 10, which remains stratified into its own layer 11 in the flow of gases as they exit the injector such that mixing of the gases only occurs downstream of the exit 3 of the outer tube 2 of the injector 1.

While the present invention has been described in terms of the above examples and detailed description, those of ordinary skill will understand that alterations may be made within the spirit of the invention. It is to be understood that the invention may assume various alternative variations and step sequences, except where expressly specified to the contrary. It is also to be understood that the specific devices and processes illustrated in the attached drawings and described in the specification are simply exemplary embodiments or aspects of the invention. Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope thereof. For example, it is to be understood that the present invention contemplates that to the extent possible, one or more features of any embodiment or aspect can be combined with one or more features of any other embodiment or aspect.

The invention claimed is:

1. An injector, comprising:

an outer cylindrical tube comprising an inner diameter and a first end and a second end, wherein said first end is connected to a source of a first non-solid and said second end comprises an annular or circular exit;

an inner cylindrical tube positioned within said outer cylindrical tube, wherein said inner cylindrical tube comprises an inner diameter and a first end and a second end wherein said first end is connected to a source of a second non-solid and said second end comprises an annular or circular exit; and wherein said second end of said inner cylindrical tube is positioned relative to said outer cylindrical tube such that said second end of said inner cylindrical tube is located an axial distance away from said second end of said outer cylindrical tube; and wherein said inner diameter of said outer cylindrical tube is configured to swirl said first non-solid and said inner diameter of said second cylindrical tube is configured to swirl said second non-solid such that said first non-solid and said second non-solid remain swirled and stratified into separate layers of flow for each non-solid as they flow through the exits of the inner and outer tubes; and wherein said first non-solid comprises supercritical CO2, water, or a mixture of supercritical CO2 and water.

2. An injector, comprising:

an outer cylindrical tube comprising an inner diameter and a first end and a second end, wherein said first end is connected to a source of a first non-solid and said second end comprises an annular or circular exit; and an inner cylindrical tube positioned within said outer cylindrical tube, wherein said inner cylindrical tube comprises an inner diameter and a first end and a second end wherein said first end is connected to a source of a second non-solid and said second end comprises an annular or circular exit; and wherein said second end of said inner cylindrical tube is positioned relative to said outer cylindrical tube such that said second end of said inner cylindrical tube is located an axial distance away from said second end of said outer cylindrical tube;

wherein said inner diameter of said outer cylindrical tube is configured to swirl said first non-solid and said inner diameter of said second cylindrical tube is configured to swirl said second non-solid such that said first non-solid and said second non-solid remain swirled and stratified into separate layers of flow for each non-solid as they flow through the exits of the inner and outer tubes; and wherein said first non-solid comprises supercritical CO2 and said second non-solid comprises CH4.

3. The injector of claim 1, wherein the injector tubes are configured to swirl the first and second non-solids by tangential entry of the first and second non-solids into the injector tubes, rifling on the inner surface of the inner and outer injector tubes, or helical ribbon inserts within the inner and outer injector tubes.

4. A method of injecting an inert into a combustion chamber comprising at least one injector comprising an outer tube and an inner tube positioned within said outer tube comprising the steps of:

flowing an inert consisting of an inert into said outer tube of said at least one injector;

swirling the inert as it flows through said outer tube;

flowing a non-solid into said inner tube of said at least one injector;

swirling the non-solid as it flows through said inner tube;

injecting the swirled inert and swirled non-solid from said outer and inner tubes into said combustion chamber such that the swirled inert delays the mixing of swirled non-solid in said combustion chamber thereby preventing reactions for some distance beyond the point of injection of said at least one injector.

5. The method of claim 4 wherein said non-solid comprises fuel.

6. The method of claim 4 wherein said non-solid comprises oxidizer.

7. A method of injecting an inert into a combustion chamber comprising at least one injector comprising an outer tube and an inner tube positioned within said outer tube comprising the steps of:

flowing the inert into said outer tube of said at least one injector;

swirling the inert as it flows through said outer tube;

flowing a non-solid into said inner tube of said at least one injector;

swirling the non-solid as it flows through said inner tube; and injecting the swirled inert and swirled non-solid from said outer and inner tubes into said combustion chamber such that the swirled inert delays the mixing of swirled non-solid in said combustion chamber thereby preventing reactions for some distance beyond the point of injection of said at least one injector, wherein said inert comprises supercritical CO2 and said non-solid comprises CH4.

8. A method of injecting a non-solid into a combustion chamber comprising at least one injector comprising an outer tube and an inner tube positioned within said outer tube comprising the steps of:

flowing the non-solid into said outer tube of said at least one injector to form an outer stream of the non-solid;

swirling the non-solid as its flows through said inner tube;

flowing the non-solid into said inner tube of said at least one injector to form an inner stream of the non-solid; and injecting the non-solid from said outer and inner tubes into said combustion chamber such that the inner and outer streams enter into said combustion chamber with enhanced turbulence caused by the inner and outer streams experiencing high shear forces due to either a difference in axial velocity, a difference in swirl velocity or direction, or a combination of these effects, downstream of said at least one injector, wherein said non-solid comprises fuel.

9. The method of claim 8 further comprising swirling the non-solid as its flows through said inner tube.

10. A method of injecting a non-solid into a combustion chamber comprising at least one injector comprising an outer tube and an inner tube positioned within said outer tube comprising the steps of:

flowing the non-solid into said outer tube of said at least one injector to form an outer stream of the non-solid;

flowing the non-solid into said inner tube of said at least one injector to form an inner stream of the non-solid; and injecting the non-solid from said outer and inner tubes into said combustion chamber such that the inner and outer streams enter into said combustion chamber with enhanced turbulence caused by the inner and outer streams experiencing high shear forces due to either a difference in axial velocity, a difference in swirl velocity or direction, or a combination of these effects, downstream of said at least one injector, wherein said non-solid comprises fuel.

11. The method of claim 8 wherein said non-solid comprises oxidizer.

12. A method of injecting a first non-solid and a second non-solid into a combustion chamber comprising at least one injector comprising an outer tube and an inner tube positioned within said outer tube comprising the steps of:

flowing the first non-solid into said outer tube of said at least one injector;

flowing the second non-solid into said inner tube of said at least one injector;

injecting the first and second non-solids from said outer and inner tubes into said combustion chamber such that the first and second non-solids remain stratified as they enter said combustion chamber thereby delaying mixing of the second non-solid located in the inner tube until downstream of said at least one injector; and wherein said first non-solid comprises supercritical CO2, water, or a mixture of supercritical CO2 and water.

13. A method of injecting a first non-solid and a second non-solid into a combustion chamber comprising at least one injector comprising an outer tube and an inner tube positioned within said outer tube comprising the steps of:

flowing the first non-solid into said outer tube of said at least one injector;

flowing the second non-solid into said inner tube of said at least one injector; and injecting the first and second non-solids from said outer and inner tubes into said combustion chamber such that the first and second non-solids remain stratified as they enter said combustion chamber thereby delaying mixing of the second non-solid located in the inner tube until downstream of said at least one injector, wherein said first non-solid comprises a first fuel and said second non-solid comprises a second fuel different than said first fuel.

14. A method of injecting a first non-solid and a second non-solid into a combustion chamber comprising at least one injector comprising an outer tube and an inner tube positioned within said outer tube comprising the steps of:

flowing the first non-solid into said outer tube of said at least one injector;

flowing the second non-solid into said inner tube of said at least one injector; and injecting the first and second non-solids from said outer and inner tubes into said combustion chamber such that the first and second non-solids remain stratified as they enter said combustion chamber thereby delaying mixing of the second non-solid located in the inner tube until downstream of said at least one injector, wherein said first non-solid comprises a first oxidizer and said second non-solid comprises a second oxidizer different than said first oxidizer.

15. The method of claim 12 further comprising swirling the first non-solid as it flows through said outer tube.

16. The method of claim 12 further comprising swirling the second non-solid as its flows through said inner tube.

17. The method of claim 15 further comprising swirling the second non-solid as it flows through said inner tube.

18. A method of injecting a first non-solid and a second non-solid into a combustion chamber comprising at least one injector comprising an outer tube and an inner tube positioned within said outer tube comprising the steps of:

flowing the first non-solid into said outer tube of said at least one injector;

flowing the second non-solid into said inner tube of said at least one injector;

injecting the first and second non-solids from said outer and inner tubes into said combustion chamber such that the first and second non-solids remain stratified as they enter said combustion chamber thereby delaying mixing of the second non-solid located in the inner tube until downstream of said at least one injector, and swirling the second non-solid as it flows through said inner tube, wherein said first non-solid comprises a first fuel and said second non-solid comprises a second fuel different than said first fuel.

* * * * *